US005479991A

United States Patent [19]

Robison et al.

[11] Patent Number: 5,479,991

[45] Date of Patent: Jan. 2, 1996

[54] REELED TUBING DEPLOYED PACKER WITH CONTROL LINE BYPASS

[75] Inventors: Clark E. Robison, Plano; Dennis D. Rood, Carrollton, both of Tex.

[73] Assignee: Halliburton, Dallas, Tex.

[21] Appl. No.: 178,703

[22] Filed: Jan. 10, 1994

[51] Int. Cl.[6] ..... E21B 33/12

[52] U.S. Cl. ..... 166/387; 166/133

[58] Field of Search ..... 166/387, 133, 166/150, 152, 183, 188

[56] References Cited

U.S. PATENT DOCUMENTS

| | | | |
|---|---|---|---|
| 4,425,965 | 1/1984 | Bayh, III et al. | 166/106 |
| 4,529,035 | 7/1985 | Bayh, III | 166/106 |
| 4,540,047 | 9/1985 | Akkerman | 166/133 X |
| 4,625,798 | 12/1986 | Bayh, III | 166/106 |
| 4,632,184 | 12/1986 | Rentroe Jr. et al. | 166/188 X |
| 4,913,239 | 4/1990 | Bayh, III | 166/385 |
| 4,917,187 | 4/1990 | Burns et al. | 166/133 X |
| 5,094,294 | 3/1992 | Bayh, III | 166/106 |

*Primary Examiner*—William P. Neuder
*Attorney, Agent, or Firm*—H. Dale Langley, Jr.

[57] ABSTRACT

A packer for a subterranean oil and/or gas well. The packer has a control signal bypass passage incorporated in the packer body. The control signal bypass passage may be opened and closed via reeled tubing to selectively allow and disallow passage of a control signal through the packer. The packer supports an electric submersible pump for enhancing flow of well fluids. The control signal bypass passage of the packer connects with a control line from the surface and with a separate control line extending downhole from the packer in the well. The control line, downhole from the packer, connects with a safety valve operable by control signal passed from the surface, through the packer, and downhole through the control signal bypass passage of the packer.

31 Claims, 2 Drawing Sheets

REELED TUBING DEPLOYED PACKER WITH CONTROL LINE BYPASS

BACKGROUND OF THE INVENTION

1. Field of the Invention

The invention generally relates to a packer having a bypass passage for use in a wellbore and, more particularly, relates to a packer with a control line bypass passage that allows control of a valve located below an electric submersible pump or other device within a wellbore to prevent fluids from flowing from the well during operations on the electric submersible pump or other device.

2. Description of the Related Art

Electric submersible pumps are commonly used in petroleum production applications, as well as other applications. In a common arrangement, an electric submersible pump may be located below the surface within a wellbore to aid fluid flow from formations downhole, through the wellbore, to the surface. Other configurations are possible for an electric submersible pump. It is likely that use of these pumps will continue into the future.

When employing a submersible pump in a wellbore, the pump must be run into the wellbore and set in place for use. As with all mechanical and electrical apparatus, problems sometimes occur in operation of electric submersible pumps after located downhole. When problems occur, it often becomes necessary to retrieve the pump from within the wellbore. In addition to the instance of problems, there may be other reasons for retrieving or otherwise manipulating an electric submersible pump within a wellbore.

In any event, manipulating an electric submersible pump located within a wellbore in setting or retrieving can be problematic. One possible problem with potentially severe consequences is loss of fluids from the wellbore. In its most severe form, this loss of fluids is referred to as well blow-out. In order to prevent that type problem, operators often employ a variety of safety mechanisms to shut-in the well or otherwise prevent or direct fluid flow therefrom during operations involving an electric submersible pump.

Several factors regarding the typical wellbore are helpful to the operator in preventing flow problems during operations like retrieval or other manipulation of an electric submersible pump downhole. One factor is wellhead equipment, such as blow-out preventers. Blow-out preventers that run coil tubing are generally affixed atop the wellbore at the surface. An electric submersible pump may be run into the wellbore on the coil tubing with the blow-out preventer aiding in preventing fluid loss from the wellbore. Another factor helpful to the operator in preventing flow problems is the fluid in the wellbore. The fluid in the wellbore can serve as a barrier to flow from the wellbore due to the hydrostatic pressure of the fluid. Even with these and other possible mechanisms for preventing fluid flow from the wellbore during downhole operations, it would be advantageous to provide an additional barrier which would allow shut-in of the well to eliminate flow during operations within the wellbore.

The present invention provides such an additional barrier which may be located within the wellbore below a downhole device, such as an electric submersible pump, which may selectively shut-in the well when manipulating the device or performing other operations thereon. The invention may be a separate mechanism from the electric submersible pump, or other downhole device, and so may be manipulated separately and controlled internally. Even further, the invention serves as a safety mechanism which prevents flow from the wellbore when not controlled to open to allow flow.

The prior discussion has addressed problems encountered by an operator during downhole operations involving an electric submersible pump. Those same and similar problems may, however, be encountered in other downhole operations as well and with other well mechanisms and devices. The present invention provides an additional safeguard to prevent fluid loss in connection with a multitude of those mechanisms and devices when undertaking a wide variety of operations downhole within a wellbore. The invention is, thus, a significant improvement in the technology and art and provides these and numerous other advantages and possibilities.

SUMMARY OF THE INVENTION

The invention is a packer for use in a subterranean wellbore. The packer includes a control line bypass passage which allows a control signal to pass through the packer.

In one embodiment, the invention is a packer that serves to seal-off a flow passageway of a first fluid. The packer comprises a bypass passage for allowing a control signal to bypass the packer.

In another aspect, the control signal is a second fluid and the bypass is an opening through the packer.

In another embodiment, the invention is an assembly which selectively and independently controls flows of a first fluid through a first flow passageway and a second fluid through a second flow passageway. The assembly is located within a cross-section of the first flow passageway, substantially normal to the direction of flow of the first fluid through the first flow passageway. The assembly is also located within a cross-section of the second flow passageway, substantially normal to the direction of flow of the second fluid through the second flow passageway. The assembly comprises means, incorporated with the assembly, for selectively allowing the first fluid to bypass the assembly, the first fluid enters the assembly on one side of the cross-section and exits the assembly on the other side of the cross-section, and means, incorporated with the assembly, for selectively allowing the second fluid to bypass the assembly, the second fluid enters the assembly on one side of the cross-section and exits the assembly on the other side of the cross-section.

In another aspect, the assembly is sealed against the first flow passageway.

In a further aspect, the means for allowing the first fluid to bypass is a first bore through the assembly.

In yet another aspect, the means for allowing the second fluid to bypass is a second bore through the assembly.

In yet a further aspect, the second bore may be selectively opened and closed.

In an even further aspect, the second fluid serves to control a controllable device, the controllable device serving to control flow of the first fluid.

In an even further aspect, an electric submersible pump is located within the first bore for operating on the first fluid.

In another further aspect, the controllable device controls flow of the first fluid to allow manipulation of the electric submersible pump.

In another embodiment, the invention is a packer located within a substantially cylindrical fluid flow passage. The fluid flow passage has a first end and a second end. The packer serves to seal the fluid flow passage at a location between the first end and the second end. The fluid flow passage also contains a controllable device located between the packer and the second end. The packer comprises means for allowing the first fluid to bypass the packer within the fluid flow passage, means for facilitating a control signal near the first end of the fluid flow passage, means for delivering the control signal to the packer, means for allowing the control signal to bypass the packer, and means for delivering the control signal, having bypassed the packer, to the controllable device.

In another aspect, the means for allowing the first fluid to bypass is a borehole through the packer.

In yet another aspect, the means for allowing the control signal to bypass the packer is a bypass passage through the packer.

In a further aspect, an electric submersible pump fits within the borehole and controls flow of a fluid from near the second end, through the packer, to near the first end.

In even a further aspect, the control signal is fluid pressure, the fluid pressure at a first side of the packer towards the first end being selectively allowed to pass to a second side of the packer towards the second end in order to signal the controllable device.

In another aspect, the means for allowing the control signal to bypass the packer is disabled to prevent the control signal from bypassing the packer when the electric submersible pump is removed from within the borehole.

In even another aspect, the controllable device is a fail-closed valve, the valve, when not supplied with the control signal, is closed, sealing the fluid flow passage to prevent flow across the valve.

In another further aspect, the means for allowing the first fluid to bypass is a borehole through the packer, an electric submersible pump fits within the borehole and controls flow of a fluid from near the second end, through the packer, to near the first end, and the means for allowing the control signal to bypass the packer is disabled to prevent the control signal from bypassing the packer when the electric submersible pump is removed from within the borehole.

In an even further aspect, the fluid flow passage is a subterranean wellbore.

In another embodiment, the invention is a packer. The packer comprises first means for location within a subterranean wellbore, the subterranean wellbore being a generally cylindrical cavity with a longitudinal axis and an upper end and a lower end, the first means having an incorporated first fluid flow passage for flow of a first fluid contained in the subterranean wellbore from the lower end to the upper end of the subterranean wellbore, the first means also having an incorporated control signal bypass passage leading to a first communication port, and second means for engaging with the first means, the second means having a second communication port for communicating with the first communication port of the first means when the second means is selectively oriented with respect to the first means, the second communication port connecting with a control line bore incorporated with the second means, wherein the select orientation of the second communication port and the control line bore of the second means with respect to the control signal bypass passage and the first communication port of the first means provides a second fluid flow passage through the packer.

In even another embodiment, the invention is a method for shutting-in a subterranean well. The method comprises the steps of providing a packer with a first flow passageway for flow of a first fluid from the well, providing the packer with a second flow passageway for flow of a second fluid into the well, locating the packer in the well at a desired location, regulating flow of the first fluid in the first flow passageway, and selectively enabling flow of the second fluid into the well to shut-in the well.

In another aspect, the selectively enabling step is controlled at a remote location from the packer.

In even another aspect, the first flow passageway is equipped with an electric submersible pump for promoting flow of the first fluid.

In yet another aspect, the step of selectively enabling flow causes the second fluid to flow to a safety valve located within the well below the packer, the flow causing the safety valve to close, sealing the well.

In another embodiment, the invention is a method for controlling flow of a first fluid. The first fluid is contained in a substantially cylindrical fluid flow passage having a first end and a second end. The method comprises the steps of delivering a control signal to a packer located within the fluid flow passage, providing the packer with a bypass means for the control signal, allowing the bypass means to pass the control signal through the packer, and delivering the control signal passed through the packer by the control means to a safety valve responsive to the control signal.

In another aspect, the safety valve is a fail-closed design, the safety valve remaining open only if the control signal is being passed through the packer and delivered to the safety valve.

In yet another aspect, the method further comprises the step of enhancing flow of the first fluid through the fluid flow passage.

In even another aspect, the safety valve is a fail-closed design, the safety valve remaining open only if the control signal is being passed through the packer and delivered to the safety valve.

In yet another aspect, the step of enhancing is performed by an electric submersible pump.

In even another embodiment, the invention is a method for controlling flow of a first fluid in a subterranean wellbore. The subterranean wellbore is a generally cylindrical cavity with a longitudinal axis and an upper end and a lower end. The method comprises the steps of locating first means within the subterranean wellbore, the first means having an incorporated first fluid flow passage for flow of a first fluid contained in the subterranean wellbore from the lower end to the upper end of the subterranean wellbore, the first means also having an incorporated control signal bypass passage leading to a first communication port, and locating second means within the subterranean wellbore, the second means engaging with the first means, the second means having a second communication port for communicating with the first communication port of the first means when the second means is selectively oriented with respect to the first means, the second communication port connecting with a control line bore incorporated with the second means, wherein the select orientation of the second communication port and the control line bore of the second means with respect to the control signal bypass passage and the first communication port of the first means provides a second fluid flow passage through the packer.

In another aspect, the method further comprises the step of selectively orienting the second means with the first means to align and disalign the second communication port with the first communication port to enable and disable, respectively, flow through the second fluid flow passage.

BRIEF DESCRIPTION OF THE DRAWINGS

For a more complete understanding of the present invention and for further objects and advantages thereof, reference may now be had to the following description in conjunction with the accompanying drawings, in which.

DETAILED DESCRIPTION OF THE INVENTION

The present invention provides an additional safety mechanism to be employed in a wellbore in connection with a device located downhole, which device may require manipulation from time to time during the life of the well. The invention provides a packer incorporated with a bypass passage through which the safety mechanism may be selectively controlled. The safety mechanism could be, for example, a safety valve. The safety mechanism may alternatively or additionally be some other type device subject to control, which may even serve some purpose other than safety. The bypass passage of the packer allows the packer to seal in fluids within the wellbore but yet allows for a control signal to be passed to below the packer within the wellbore via the bypass passage. As will be hereinafter more fully discussed and better understood, the invention, because of the bypass passage, allows an additional barrier for well control to be placed within the wellbore and operated from the surface. In addition to that function, the invention may serve a wide variety of other functions wherein a packer is located downhole above an operating mechanism which may be controlled by a control signal generated at the surface.

Figure 1:
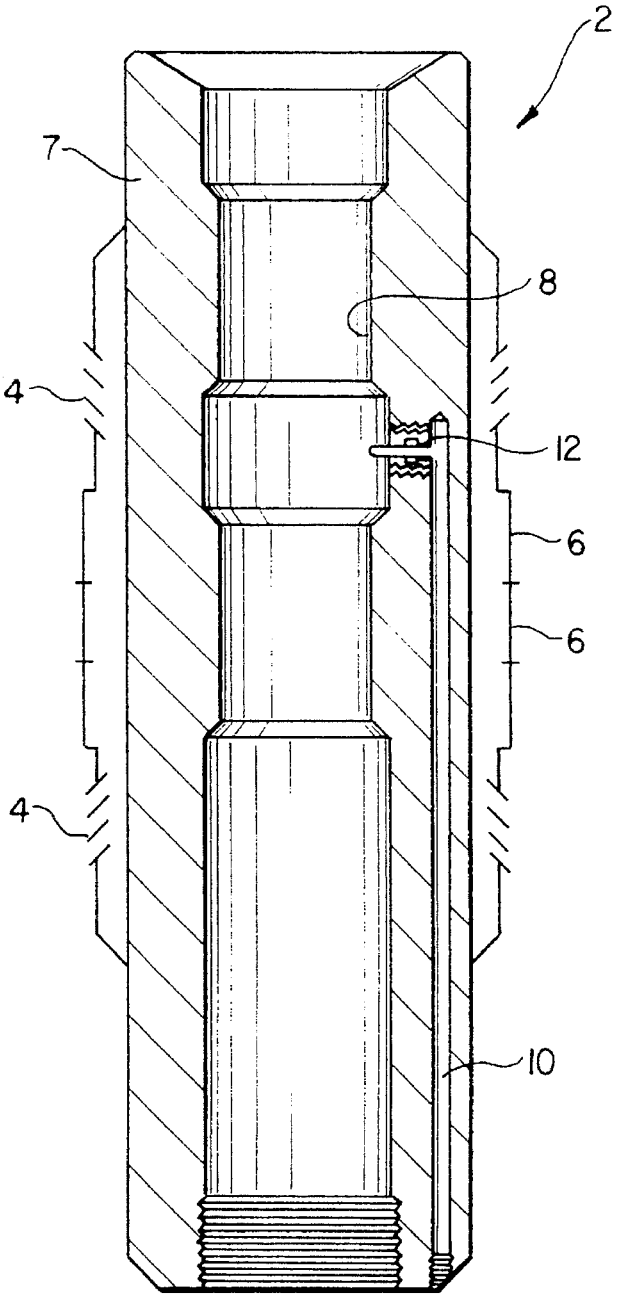
FIG. 1 is a simplified, vertically foreshortened, cross-sectional view of the packer of the present invention, showing the control line bypass passage and an illustrative valve mechanism controlling the flow through that passage.

Referring first to FIG. 1, an illustrative cross-sectional schematic of the packer 2 of the present invention is shown. The packer 2 is seen to generally comprise a mandrel 7 with a bore 8 therethrough. The mandrel 7 is cylindrical in configuration and, as will hereinafter be more particularly described, is preferentially comprised of a number of mandrel segments (not shown in FIG. 1) to allow for a variety of running, setting, and retrieval operations. The bore 8 of the mandrel 7 may be shaped to accept and retain a device, like a seal unit or discharge module, when employed downhole in a wellbore.

Still referring to FIG. 1, the mandrel 7 is seen to include a bypass passage, the control line bore 10, which passes through the mandrel 7 housing. The control line bore 10 allows for communication from a location within and towards the top of the mandrel 7 to outside and below the mandrel 7. The control line bore 10 is affixed with a control line valve 12 to control passage of a communicated signal from the bore 8 near the top of the mandrel 7 into the control line bore 10. The control line valve 12 may be configured in a wide variety of manners and is here in FIG. 1 illustrated as a generic valve. As will hereinafter be more fully described and better understood, the preferred embodiment of the present invention provides an improved sliding valve mechanism for use to accomplish the functions and operation illustrated by this simplified drawing of FIG. 1.

Continuing to refer to FIG. 1, the mandrel 7 is incorporated around its cylindrical and outer perimeter with a series of packer elements 6 and securement mechanisms such as packer slips 4. The packer elements enable the mandrel 7 to be sealed within a wellbore at a desired vertical location to contain fluids within the wellbore. The packer slips 4, together with other mechanisms not shown in detail in FIG. 1, lodge against the wellbore walls to secure the packer 2 and to allow the packer elements 6 to be squeezed to expand against the walls of the wellbore. As can now be understood in concept, the packer 2, by means of the control line valve 12 and control line bore 10, can restrict fluid flow from within the wellbore but yet allow selective communication via the control line bore 10 across the packer 2 from top to bottom. This aspect of the packer 2 allows for use of the packer 2 to control a mechanism or device, such as a valve, located below the packer 2 in the wellbore.

Further referring to FIG. 1, communication across the packer 2 via the control line bore 10 may be by a wide variety of means, such as fluid or gas pressure, or other means. The mechanism or device located below the packer 2 and being controlled may be any of a number of mechanisms and devices which may be controlled by such fluid or gas pressure or other control means. In the description that follows, a particular embodiment of the invention packer 2 controlling a foot valve located below an electric submersible pump in a wellbore, each of the valve and pump being downhole from the packer 2, is illustrated and described. In that particular embodiment, the packer 2 serves to retain the electric submersible pump in vertical location within the wellbore and allows for bypass of the packer 2 and pump of a control signal which may be employed to operate the foot valve located downhole from the pump and packer 2.

Figure 2:
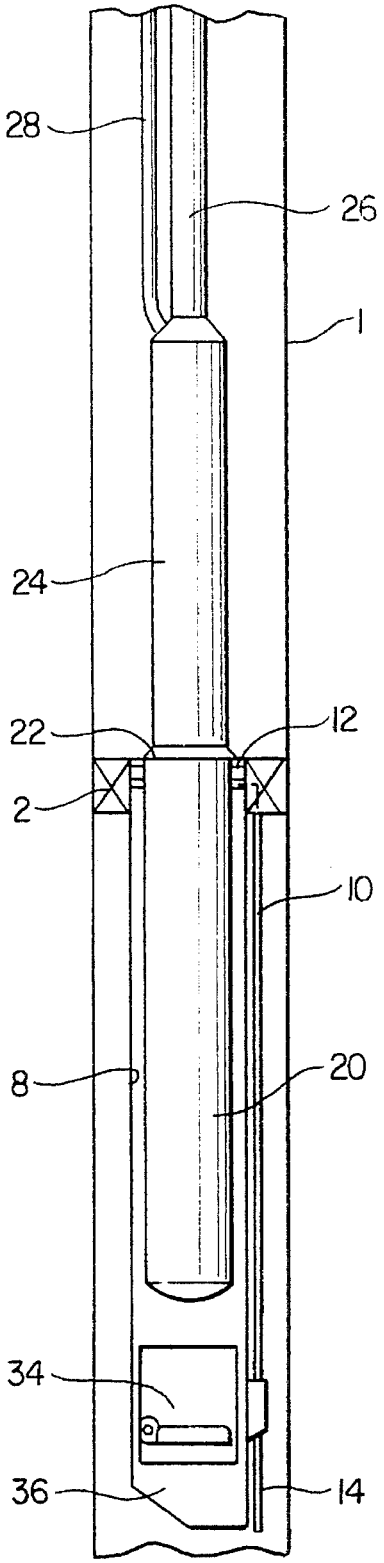
FIG. 2 is a simplified, vertically foreshortened, cross-sectional view of a representative subterranean wellbore, showing the packer of the invention with control line bypass passage, an electric submersible pump, and a safety valve connected by a control line with the packer control line bypass passage, each located within the wellbore for operation.

Now referring to FIG. 2, an illustrative example of the embodiment of the packer 2 employed in conjunction with an electric submersible pump 20 and foot valve 34 is shown. In this illustration of that embodiment, the packer 2 is located within a wellbore 1. The wellbore 1 extends from the surface of the ground to a subterranean location below the surface. The packer 2 is located downhole within the wellbore 1 from the surface. Once the packer 2 has been located an appropriate distance downhole within the wellbore 1, the packer 2 is set within the wellbore 1 by some known setting mechanism, such as the packer elements 6, packer slips 4, and possibly other means, as previously discussed with respect to FIG. 1.

Still referring to FIG. 2, the packer 2 is seen to incorporate the control line valve 12 and control line bore 10 which were described in connection with the discussion of FIG. 1. After the packer 2 is set in the wellbore 1, a mechanism or device, such as an electric submersible pump 20, is lowered through the packer 2 and retained therein. In the illustration, the electric submersible pump 20 is connected to a locking module discharge head 22. The locking module discharge head 22 is affixed with an electric submersible pump motor 24. The motor 24 is connected with reeled tubing 26 and a power cable 28. The reeled tubing may be of any suitable size and diameter for the particular operation. The power cable 28 may take any of a variety of forms and may, but need not necessarily, be integrated with a control line (not shown in detail) to provide the control signal previously described at the control line valve 12 for flow through the control line bore 10 to the electric submersible pump 20, or other mechanism or device being controlled.

Referring further to FIG. 2, the illustration shows one suitable arrangement for the invention. In this arrangement, the control line bore 10 provides control signals to a safety valve 34. The safety valve 34 is located below the packer 2 and the electric submersible pump 20 retained within the bore 8 of the packer 2. In this arrangement, the safety valve 34 may serve to shut-in wellbore 1 fluids below the safety valve 34. When the wellbore 1 fluids are so shut-in, operations above the safety valve 34 may be undertaken with the safety valve 34 serving as a barrier to flow of fluids from the wellbore 1. The safety valve 34 is located within a safety valve landing nipple 36. The safety valve 34 is connected with the control line bore 10 at a point somewhat above the terminal end of the control line bore 10. The lowermost end of the control line 10 serves as a control line sump 14 for retention of extraneous materials flowing through the control line bore 10.

With respect to all of FIGS. 1, 2, 3A–3B and the discussion herein, though the packer 2 assembly described and illustrated is discussed with respect to an application employing an electric submersible pump 20 and a safety valve 34, other arrangements are possible. For example, the packer 2 may be employed with devices other than electric submersible pumps. In fact, any mechanism or device which must be retained in a location downhole in a wellbore and which may be problematic or which may require manipulation is a potential candidate for use of the invention. In addition to other possible applications of the invention in retaining mechanisms or devices at a location within the wellbore, the shut-off mechanism located below the packer 2, exemplified by the safety valve 34 in FIG. 2, may be any of a number of other types of control apparatus or mechanisms. In any event, the shut-off mechanism should be controllable by communication signals from the surface to the device through the control line bore 10. Finally, a variety of communication signals may be possible dependent upon the particular retained device and flow control mechanism.

Figure 3A:
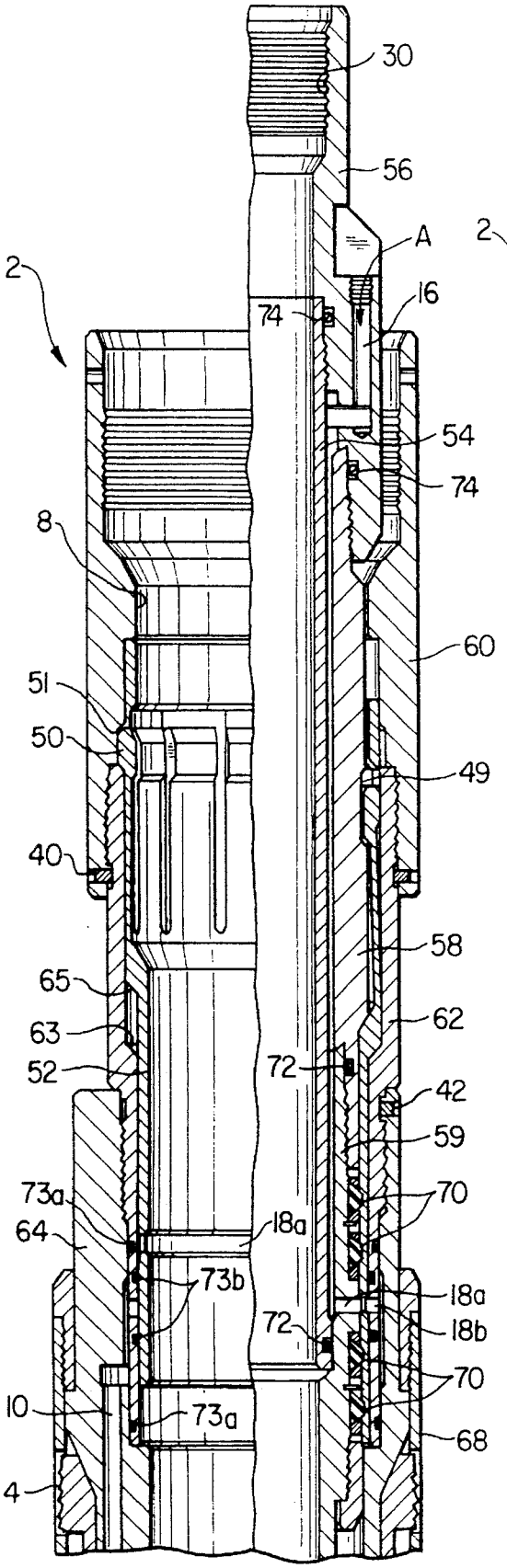
FIGS. 3A–3B are part perspective, part cross-sectional views through the packer of the present invention, showing the packer's control line bypass passage in a closed position on the left side of the longitudinal axis and in an open position on the right side of the longitudinal axis.
Figure 3B:
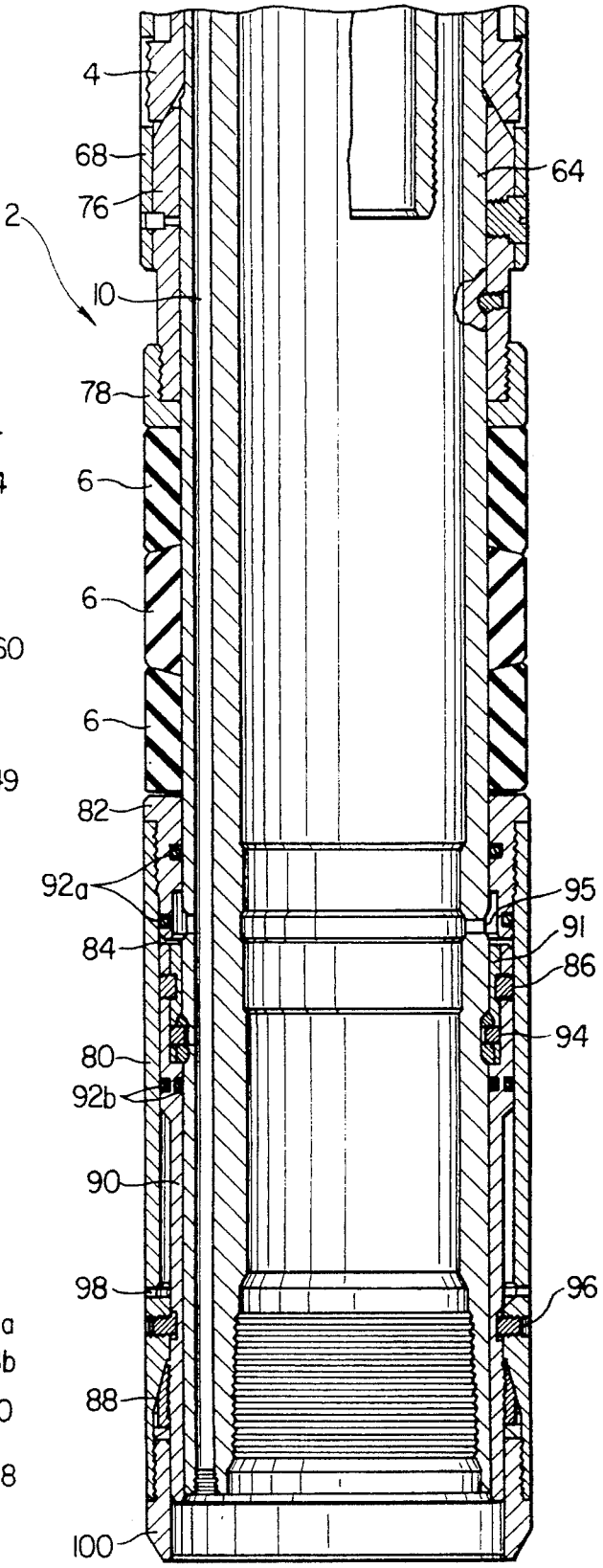

Now referring to FIGS. 3A–3B, the preferred embodiment of the present invention is depicted. This preferred embodiment is especially suited to be employed with an electric submersible pump (not shown in FIGS. 3A–3B but shown in FIG. 2) and a foot valve (also not shown in FIGS. 3A–3B but shown in FIG. 2) operable in response to pressure. As will be appreciated and readily understood by those in the art, alternative configurations and mechanisms may be possible in the invention to achieve substantially the same results or other results as may be desired in the application. The following description of the preferred embodiment of the invention should not and is not intended to be limited by the discussion of this preferred embodiment.

Still referring to FIGS. 3A–3B, the packer 2 of the invention is shown. The packer 2 consists essentially of three segments. The first segment may be thought of as a housing and a sliding plunger. This first segment is comprised of several interconnected sections and connects with an actuation mechanism, such as reeled tubing, which operates the sliding plunger to open and close, as desired. The interconnected sections of this first segment include a seal mandrel connector 56. The seal mandrel connector 56 is a generally cylindrical structure having at its upper portion tubing connection threads 30. The tubing connection threads 30 serve for connecting the first segment to reeled tubing or a seal assembly, motor or other devices. Although reeled tubing is the actuation mechanism discussed and for which this embodiment of the packer 2 here is designed, any of a variety of mechanisms which are connectible with the seal mandrel connector 56 and may be selectively moved to control the first segment from the surface is also suitable.

Continuing to refer to FIG. 3A, the seal mandrel connector 56 also includes internal threading at its lower end for connection with a seal mandrel 54. Concentric with the seal mandrel 54 is a seal unit 58 also connected with the seal mandrel connector 56 by screw threadings. The interconnections between the seal mandrel connector 56 and each of the seal mandrel 54 and seal unit 58 are sealed by upper O-rings 74. The seal mandrel connector 56 includes in the housing thereof a control line access bore 16. The control line access bore 16, as it enters from outside the seal mandrel connector 56, includes threadings for connection with a control line from the surface. The control line access bore 16 initially travels downward in a longitudinal direction through the housing of the seal mandrel connector 56. At a point within the seal mandrel connector 56, the control line access bore exits to the inner side of the seal mandrel connector 56 by a radially, inwardly directed passage. The seal mandrel 54, as previously stated, is located concentrically within the seal unit 58. The annulus formed between the seal mandrel 54 and seal unit 58 serves as a control signal path extending longitudinally through that annulus for almost the entire length of the annulus. The seal unit 58 is further connected at its lower end via threadings with a communication unit 59. The communication unit 59 is also sealed with the seal unit 58 by a lower O-ring 72. The seal mandrel 54 at its lower end also includes a lower O-ring 72 which seals the seal mandrel 54 with the communication unit 59.

Continuing still to refer to FIG. 3A, it is seen that this first segment forms a flow path for fluid or gas pressure, or other control means. The control means is illustrated by arrow A. It is seen that the control means A enters the seal mandrel connector 56 housing from outside the seal mandrel connector 56 and flows therethrough to the inner side of the seal mandrel connector 56 and into the annulus formed between the seal mandrel 54 and seal unit 58. The control means A then flows through that annulus to the communication port **18*a* of the communication unit 59 and out of the first segment into communication port 18*b*. This completes the first segment of the packer 2**.

Now referring to FIGS, 3A–3B in conjunction, that first segment of the packer 2 is seen to proceed through a second segment. The second segment, like the first segment, is comprised of several interconnected sections. At the top of the second segment is an outer sleeve 60. The outer sleeve 60 has an open end of greater inside diameter than the outer diameter of the first segment. The first segment may, thus, be lowered into the outer sleeve 60 and into the second segment, as shown in FIGS. 3A–3B, to allow operation as hereinafter more fully described. The outer sleeve 60 contains on its lower end certain internal threadings for connection with an inner sleeve 62. The inner sleeve 62 may be fixed with the outer sleeve 60 by a circumferential arrangement of one or more first screws 40. The outer sleeve 60 and inner sleeve 62 arrangement holds concentrically therein a sliding sleeve 52. The sliding sleeve 52 has at an upper location thereof a series of outwardly protruding fingers or collets 50. At the location where the outer sleeve 60 and inner sleeve 62 join, the joint forms a collet 50 receiving cavity 51. The receiving cavity 51 allows for the collet 50 to maintain its natural expanded state thus allowing the seal unit 58 to pass under collet 50. This also allows for the alignment of sliding sleeve 52 and inner sleeve 62. As will be hereinafter detailed, the seal unit 58 of the first segment includes a collet receptacle 49 indentation area which matches with the collet 50 when the first segment is lowered through the second segment. When the collet 50 is so located within the collet receptacle 49, the first segment is fixed with the sliding sleeve 52 such that vertical movement of the first segment downward causes the sliding sleeve 52 to move downward. This sliding effect of the sliding sleeve 52 in response to movement of the first segment serves as a valve to selectively allow or shut off flow of a control means A from the annulus between the seal mandrel 54 and seal unit 58 through the communication ports 18*a*, 18*b*. When open, that annulus serves as a control passage for delivering the control means A to a controllable mechanism within the wellbore located below the packer 2.

Still referring to FIG. 3A, the sliding sleeve 52 is sealed with the inner sleeve 62 by inner sleeve O-rings 73*a*. The inner sleeve 62 also contains certain inner sleeve O-rings 73*b* which serve to seal the inner sleeve 62 with other elements. Those other elements include a packer mandrel 64. The packer mandrel 64 is the mandrel which contains the packing elements 6 and other mechanisms for fixing those elements 6 within a wellbore and sealing them against the wellbore. Outwardly concentric with the packer mandrel 64 is located a slip retaining sleeve 68. Between the packer mandrel 64 and slip retaining sleeve 68 is located a series of packer slips 4. The packer slips 4 are located along the circumference of the packer mandrel 64. The packer slips 4 serve to wedge the packer 2 within a wellbore. The slip retaining sleeve 68 is fixed to an expander wedge 76 by shear pins 77. This prevents the slips 4 from activating prematurely. Of particular note is the control line bore 10 which enters the packer mandrel 64 from an upper, inner location and proceeds in a longitudinally downward direction through the packer mandrel 64 shell. This control line bore 10 allows passage of the control means A, such as fluid or gas pressure or other means, from above the packer 2 to below the packer 2.

Continuing to refer to FIG. 3B, the packer mandrel 64 is shown within an expander wedge 76. This expander wedge 76 serves to protrude under the packer slips 4 when wedging the packer 2 in a wellbore. The expander wedge 76 is fixed to packer mandrel 64 by shear screws 79. This also prevents the slips 4 from activating. The opposing expander wedge 76 profile is built onto the packer mandrel 64. At the lower end of the expander wedge 76 is located an upper element retainer 78. The upper element retainer 78 abuts the packer element 6 and is outwardly concentric with the packer mandrel 64. Expander wedge 76, upper element retainer 78, and packer element 6 are longitudinally moveable along the packer mandrel 64 after the shear screws 79 and shear pins 77 shear. This longitudinally moveable effect allows for setting and retrieving the packer 2, which will be more specifically discussed hereafter. This completes the second segment of the packer 2.

Further still continuing to refer to FIG. 3B, the third segment of the packer 2 may be understood. The third segment is located below the second segment and is outwardly concentric with the packer mandrel 64. The third segment consists at its uppermost portion with a lower element retainer 82. The lower element retainer 82 is sealed against the packer mandrel 64 via an upper O-ring 92*a*. On the outer circumference of the lower element retainer 82 is located threadings and another upper O-ring 92*a*. The threadings serve to connect with a cylinder 80, sealed with the lower element retainer 82 by the upper O-ring 92*a*. The cylinder 80 includes an equalization port 98 formed radially inward around the circumference of the cylinder 80 for equalization of wellbore pressures with pressures in an annulus formed between the cylinder 80 and a release sleeve 90. The release sleeve 90 includes at its upper end one or more release screws 86 which connect the release sleeve 90 with an inner ring 91. Outward of the inner ring 91 is the release sleeve 90 and inward of the inner ring 91 is the packer mandrel 64. Inner ring 91 is fixed to the packer mandrel 64 via split ring segments (not detailed) and set screws 94. At the lower end of the release sleeve 90 is one or more retention screws 96 for maintaining the cylinder 80 relative to the release sleeve 90. Between the release sleeve 90 and cylinder 80, within an annular gap therebetween, is located one or more internal slips 88. The internal slips 88 serve to maintain the relative positioning of the cylinder 80 and release sleeve 90, during operation of the packer 2. At the bottom of the cylinder 80 are located internal threadings to which an end retainer 100 may be connected. The end retainer 100 serves to contain the internal slips 88 within the space therefor between the cylinder 80 and release sleeve 90.

Continuing to refer to FIGS. 3A–3B, operation of the packer 2 of the present invention may be understood. The three segments of the packer 2 function in conjunction (1) to allow the packer 2 to be run into, set in, and retrieved from a wellbore, and (2) to open and close the control means bypass passage which allows communication signals to pass from the top side of the packer 2 to the bottom side of the packer 2. When running the packer 2 into a wellbore, the packer 2 does not include the first segment. In that case, the packer 2 is attached with a running tool by the threadings on the upper end of the second segment, and the second segment and third segment are lowered downhole. Once the second segment and third segment of the packer 2 reach a desired downhole location, the packer 2 is set within the wellbore at that location. Setting of the packer 2 is accomplished by standard means, to-wit, downhole pressure (or some alternate means of pressure) forces the shear screws 96 to shear allowing the cylinder 80, lower element retainer 82, internal slips 88 and end retainer 100 to move upward (as a unit). This movement applies a load through the packing elements 6 into the expander wedge 76 and upper element retainer 78, which shears shear screws 79 and allows the expander wedge 76 to move upward. The expander wedge 76 is pinned to slip retaining sleeve 68 so continued upward movement of slip retaining sleeve 68 and expander wedge 76, as a unit, deploys slips 4 onto an upper wedge ramp portion of the mandrel 64. This movement initiates slip 4 setting. Continued force shears shear pins 77 which allows the expander wedge 76 to further support the slips 4. This completes the setting of the packer slips 4. Increased force allows the cylinder 80, lower element retainer 82, internal slips 88, and end retainer 100 to continue upward travel, further compressing the elements 6 thus creating effective seal against the well casing. The packer 2 is retained in set position by the internal slips 88 which lock onto the release sleeve 90.

Still referring to FIGS. 3A–3B, once the second segment and third segment of the packer 2 are so secured within a wellbore, the first segment is lowered into the second segment and third segment of the packer 2 by some tool, such as a reeled cable affixed with the first segment at the tubing connection threads 30 thereof. As the first segment is lowered into the second segment and third segment of the packer 2, the first segment fits within the inner circumference thereof. The first segment is lowered until the seal unit 58 of the first segment meets with the sliding sleeve 52. At this point the collet 50 is aligned with the collet receptacle 49. With the collet receptacle 49 and collet 50 aligned, the first segment when moved downward causes the sliding sleeve 52 to also move downward. When the first segment is so moved downward, the collet 50 depresses and becomes disengaged from the receiving cavity 51 and slides along the inner diameter of the inner sleeve 62. The inner sleeve 62 contains a stop edge 63. This stop edge is formed to meet with a corner edge 65 of the sliding sleeve 52. The stop edge 63 contacts with the corner edge 65 as the first segment and sliding sleeve 52 are moved downward, halting the downward progression of the sliding sleeve 52 and first segment. The first segment and sliding sleeve 52, when still engaged by the collet 50 and collet receptacle 49, then may move together longitudinally upward until the stop corner 69 meets the stop edge 67 and may move together longitudinally downward until the corner edge 65 abuts the stop edge 63. This longitudinal movement of the first segment and the sliding sleeve 52 creates the desired opening and closing of the bypass passage line of the packer 2 which allows for passage of the control means A across the packer 2 from top to bottom.

Even further referring to FIGS. 3A–3B, when the first segment and sliding sleeve 52 are in the uppermost longitudinal position, the bypass passage of the packer 2 for control means A flow is closed because the communication port 18*a* of the communication unit 59 does not match with the communication port 18*b* of the inner sleeve 62. When those ports 18*a*,18*b* do not match, there is no path through the packer 2 for the control means A to flow. However, as the first segment and sliding sleeve 52 are moved downward until the corner edge 65 abuts the stop edge 63, the communication port 18*a* of the communication unit 59 aligns directly with the communication port 18*b* at the inner sleeve 62 to allow communication between the annulus formed between the seal mandrel 54 and seal unit 58 to outside the inner sleeve 62 to the pocket between the inner sleeve 62 and packer mandrel 64. At that pocket, the control line bore 10 through the packer mandrel 64 connects with the communication ports 18*a*,18*b* to allow flow of the control means A to be completed through the packer mandrel 64 and out the bottom of the packer 2. At this point at the bottom of the packer 2, the packer 2 may be connected with a control line which connects to the downhole foot valve (not shown in FIGS. 3A–3B, but shown in FIG. 2) or other controllable device.

Still referring to FIGS. 3A–3B, it is of note that the communication unit 59 is specially equipped with a series of, preferably four, molded seals 70 which seal off the communication ports 18*a*,18*b* by sealing between the communication unit 59 and sliding sleeve 52. In this configuration, by moving the first segment and affixed sliding sleeve 52 up and down, the bypass passage through the packer 2 may be closed and opened as desired. A preferred means for moving the first segment and sliding sleeve 52 up and down is reeled tubing connected with the first segment as previously described. Other means are possible to accomplish the longitudinal movement which operates the opening and closing of the bypass passage, and many such means will be recognized by those skilled in the art and all are intended as included in the description herein.

As previously described, the bypass passage through the packer 2 may be employed for delivering a control means A, such as communication signals, to a device, such as a foot valve, located below the packer 2 within the wellbore. A preferred use of the bypass passage of the packer 2 is delivering a communication signal to operate a downhole valve to opened or closed position. In the instance where a foot valve is the downhole mechanism being controlled, the foot valve may be fail-closed and opened only when a communication signal to that effect is passed through the packer 2 via the bypass passage and to the valve. Thus, in such an arrangement, the valve may be maintained open to allow flows upward within the wellbore so long as the communication signal is being delivered to the valve. If, however, the communication signal is not being delivered to the valve, the valve would be closed. This arrangement will provide an additional safety mechanism in a well which will function as a flow barrier to prevent flow from a wellbore.

Further still referring to FIGS. 3A–3B, the packer 2 may be retrieved from a wellbore in a typical manner. For example, in the case of the preferred embodiment configuration of the packer 2, as described herein, an upward force may be applied to the packer 2 sufficient to break the release screws 86. This can occur by, for example, running and latching a retreiving tool (not shown) into threads in the top of the outer sleeve 60; applying an upward strand on the outer sleeve 60 which is transmitted through the split ring segments (not detailed) under inner ring 91 into inner ring 91 which shears the release screws 86; continued upward pull releases the ramp wedge portion of the packer mandrel 64 from under the packer slips 4; compressive force stored in the packer elements 6 pushes the cylinder 80, lower element retainer 82, internal slips 88, end retainer 100, and the release sleeve 90, as a unit, downward; finally, packer mandrel 64 picks up slip retaining sleeve 68 and retracts slips 4 from the expander wedge 76. This returns slip retaining sleeve 68, the packer slips 4, the expander wedge 76, and the upper element retainer 78 back to their original non-set position. In that position, then, the cylinder 80, lower element retainer 82, internal slips 88, and retainer 100, and release sleeve 90 are retained from further downward travel by the lower element retainer 82 contacting the inner ring 91.

Once the jam against the wellbore by the packer elements 6 and packer slips 4 is released in the aforedescribed manner, the entire packer 2 may be pulled upward within the wellbore and removed from or relocated within the wellbore as desired. Because the foot valve in the preferred arrangement is fail-closed in that preferred arrangement, the removal of the packer 2 does not affect the valve operation in restraining wellbore flow.

The herein described preferred embodiment of the packer 2, and the numerous alternative embodiments and variations thereof described herein or otherwise apparent to those skilled in the art, thus, provide for advantages over the prior technology. In the manufacture of the packer 2, all parts are preferably formed of materials such as solid, strong steel, iron, composition, or combinations thereof. The parts are also preferably cast and precision machined to provide for maximum strength and appropriate tolerances.

As is clearly seen, the present invention provides significant advantages in the technology. The present invention is believed to be especially effective when manufactured and employed as described herein, however, those skilled in the art will readily recognize that numerous variations and substitutions may be made in the device and method and its use, steps, and manufacture to achieve substantially the same results achieved by the embodiments and, in particular, the preferred embodiment expressed and described herein. Each of those variations is intended to be included in the description herein and forms a part of the present invention. The foregoing detailed description is, thus, to be clearly understood as being given by way of illustration and example only, the spirit and scope of the present invention being limited solely by the appended claims.

What is claimed is:

1. A packer which serves to seal-off a flow passageway of a first fluid, comprising a bypass passage for allowing a control signal to bypass said packer.

2. The packer of claim 1, wherein said control signal is a second fluid and said bypass is an opening through said packer.

3. An assembly which selectively and independently controls flows of a first fluid through a first flow passageway and a second fluid through a second flow passageway, said assembly being located within a cross-section of said first flow passageway, substantially normal to the direction of flow of said first fluid through said first flow passageway, and said assembly being located within a cross-section of said second flow passageway, substantially normal to the direction of flow of said second fluid through said second flow passageway, said assembly comprising:

means, incorporated with said assembly, for selectively allowing said first fluid to bypass said assembly, said first fluid enters said assembly on one side of said cross-section and exits said assembly on the other side of said cross-section; and means, incorporated with said assembly, for selectively allowing said second fluid to bypass said assembly, said second fluid enters said assembly on one side of said cross-section and exits said assembly on the other side of said cross-section.

4. The assembly of claim 3, wherein said assembly is sealed against said first flow passageway.

5. The assembly of claim 4, wherein said means for allowing said first fluid to bypass is a first bore through said assembly.

6. The assembly of claim 5, wherein said means for allowing said second fluid to bypass is a second bore through said assembly.

7. The assembly of claim 6, wherein said second bore may be selectively opened and closed.

8. The assembly of claim 7, wherein said second fluid serves to control a controllable device, said controllable device serving to control flow of said first fluid.

9. The assembly of claim 8, wherein an electric submersible pump is located within said first bore for operating on said first fluid.

10. The assembly of claim 9, wherein said controllable device controls flow of said first fluid to allow manipulation of said electric submersible pump.

11. A packer located within a substantially cylindrical fluid flow passage containing a first fluid, said fluid flow passage having a first end and a second end, said packer serves to seal said fluid flow passage at a location between said first end and said second end, said fluid flow passage also contains a controllable device located between said packer and said second end, said packer comprising:

means for allowing said first fluid to bypass said packer within said fluid flow passage;

means for facilitating a control signal near said first end of said fluid flow passage;

means for delivering said control signal to said packer;

means for allowing said control signal to bypass said packer; and means for delivering said control signal, having bypassed said packer, to said controllable device.

12. The packer of claim 11, wherein said means for allowing said first fluid to bypass is a borehole through said packer.

13. The packer of claim 11, wherein said means for allowing said control signal to bypass said packer is a bypass passage through said packer.

14. The packer of claim 12, wherein an electric submersible pump fits within said borehole and controls flow of a fluid from near said second end, through said packer, to near said first end.

15. The packer of claim 13, wherein said control signal is fluid pressure, said fluid pressure at a first side of said packer towards said first end being selectively allowed to pass to a second side of said packer towards said second end in order to signal said controllable device.

16. The packer of claim 15, wherein said controllable device is a fail-closed valve, said valve, when not supplied with said control signal, is closed, sealing said fluid flow passage to prevent flow across said valve.

17. The packer of claim 16, wherein said means for allowing said first fluid to bypass is a borehole through said packer, an electric submersible pump fits within said borehole and controls flow of a fluid from near said second end, through said packer, to near said first end, and said means for allowing said control signal to bypass said packer is disabled to prevent said control signal from bypassing said packer when said electric submersible pump is removed from within said borehole.

18. The packer of claim 17, wherein said fluid flow passage is a subterranean wellbore.

19. A packer located within a substantially cylindrical fluid flow passage containing a first fluid, said fluid flow passage having a first end and a second end, said packer serves to seal said fluid flow passage at a location between said first end and said second end, said fluid flow passage also contains a controllable device located between said packer and said second end, said packer comprising:

means for allowing said first fluid to bypass said packer within said fluid flow passage;

means for facilitating a control signal near said first end of said fluid flow passage;

means for delivering said control signal to said packer;

means for allowing said control signal to bypass said packer; and means for delivering said control signal, having bypassed said packer, to said controllable device;

wherein said means for allowing said first fluid to bypass is a borehole through said packer;

wherein an electric submersible pump fits within said borehole and controls flow of a fluid from near said second end, through said packer, to near said first end; and wherein said means for allowing said control signal to bypass said packer is disabled to prevent said control signal from bypassing said packer when said electric submersible pump is removed from within said borehole.

20. A packer, comprising:

first means for location within a subterranean wellbore, said subterranean wellbore being a generally cylindrical cavity with a longitudinal axis and an upper end and a lower end, said first means having an incorporated first fluid flow passage for flow of a first fluid contained in said subterranean wellbore from said lower end to said upper end of said subterranean wellbore, said first means also having an incorporated control signal bypass passage leading to a first communication port; and second means for engaging with said first means, said second means having a second communication port for communicating with said first communication port of said first means when said second means is selectively oriented with respect to said first means, said second communication port connecting with a control line bore incorporated with said second means;

wherein said select orientation of said second communication port and said control line bore of said second means with respect to said control signal bypass passage and said first communication port of said first means provides a second fluid flow passage through said packer.

21. A method for shutting-in a subterranean well, comprising the steps of:

providing a packer with a first flow passageway for flow of a first fluid from said well;

providing said packer with a second flow passageway for flow of a second fluid into said well;

locating said packer in said well at a desired location;

valving flow of said first fluid in said first flow passageway; and selectively enabling flow of said second fluid into said well to effect said step of valving in order shut-in said well.

22. The method of claim 21, wherein said selectively enabling step is controlled at a remote location from said packer.

23. The method of claim 22, wherein said first flow passageway is equipped with an electric submersible pump for promoting flow of said first fluid.

24. The method of claim 23, wherein said step of selectively enabling flow causes said second fluid to flow to a safety valve located within said well below said packer, said flow causing said safety valve to close sealing the well.

25. A method for controlling flow of a first fluid, said first fluid contained in a substantially cylindrical fluid flow passage having a first end and a second end, comprising the steps of:

delivering a control signal to a packer located within said fluid flow passage;

providing said packer with a bypass means for said control signal;

allowing said bypass means to pass said control signal through said packer; and delivering said control signal passed through said packer by said control means to a safety valve responsive to said control signal.

26. The method of claim 25, wherein said safety valve is a fail-closed design, said safety valve remaining open only if said control signal is being passed through said packer and delivered to said safety valve.

27. The method of claim 25, further comprising the step of enhancing flow of said first fluid through said fluid flow passage.

28. The method of claim 27, wherein said safety valve is a fail-closed design, said safety valve remaining open only if said control signal is being passed through said packer and delivered to said safety valve.

29. A method for controlling flow of a first fluid, said first fluid contained in a substantially cylindrical fluid flow passage having a first end and a second end, comprising the steps of:

delivering a control signal to a packer located within said fluid flow passage:

providing said packer with a bypass means for said control signal;

allowing said bypass means to pass said control signal through said packer;

delivering said control signal passed through said packer by said control means to a safety valve responsive to said control signal;

enhancing flow of said first fluid through said fluid flow passage;

wherein said safety valve is a fail-close design, said safety valve remaining open only if said control signal is being passed through said packer and delivered to said safety valve; and wherein said step of enhancing is performed by an electric submersible pump.

30. A method for controlling flow of a first fluid in a subterranean wellbore, said subterranean wellbore being a generally cylindrical cavity with a longitudinal axis and an upper end and a lower end, comprising the steps of:

locating first means within said subterranean wellbore, said first means having an incorporated first fluid flow passage for flow of a first fluid contained in said subterranean wellbore from said lower end to said upper end of said subterranean wellbore, said first means also having an incorporated control signal bypass passage leading to a first communication port; and locating second means within said subterranean wellbore, said second means engaging with said first means, said second means having a second communication port for communicating with said first communication port of said first means when said second means is selectively oriented with respect to said first means, said second communication port connecting with a control line bore incorporated with said second means;

wherein said select orientation of said second communication port and said control line bore of said second means with respect to said control signal bypass passage and said first communication port of said first means provides a second fluid flow passage through said packer.

31. The method of claim 30, further comprising the step of selectively orienting said second means with said first means to align and disalign said second communication port with said first communication port to enable and disable, respectively, flow through said second fluid flow passage.

* * * * *